US006053790A

United States Patent [19]

Langford

[11] Patent Number: 6,053,790

[45] Date of Patent: Apr. 25, 2000

[54] TRAIN COUPLEABLE FLOTATION TUBE FOR WATERSLIDES

[76] Inventor: Frederick Langford, 212 Crest Rd., P.O. Box 245, Cape May Court House, N.J. 08210

[21] Appl. No.: 09/052,177

[22] Filed: Mar. 31, 1998

[51] Int. Cl.[7] ..... B63C 9/08

[52] U.S. Cl. ..... 441/129; 114/248; 114/267

[58] Field of Search ..... 114/345, 346, 114/246, 248, 267; 472/128, 129; 441/67, 68, 129–132

[56] References Cited

U.S. PATENT DOCUMENTS

| | | | |
|---|---|---|---|
| 1,005,236 | 10/1911 | Larr | 114/248 |
| 3,486,476 | 12/1969 | Breit, Jr. | 114/248 |
| 4,516,943 | 5/1985 | Spieldiener et al. . | |
| 4,583,479 | 4/1986 | Lehmann . | |
| 4,894,033 | 1/1990 | Chang . | |
| 4,968,278 | 11/1990 | Lemke et al. . | |
| 4,984,783 | 1/1991 | Fujimaki . | |
| 5,011,134 | 4/1991 | Langford . | |
| 5,020,465 | 6/1991 | Langford . | |
| 5,101,752 | 4/1992 | Smollar et al. | 441/66 |
| 5,167,554 | 12/1992 | Tager et al. . | |
| 5,230,662 | 7/1993 | Langford . | |
| 5,299,964 | 4/1994 | Hopkins . | |
| 5,356,132 | 10/1994 | McEwan et al. . | |
| 5,358,438 | 10/1994 | Wolfe | 441/129 |
| 5,453,054 | 9/1995 | Langford . | |
| 5,507,674 | 4/1996 | Yeung . | |

OTHER PUBLICATIONS

Leslie J. Nicholson, Riding to Extremes, May 7, 1998. The Philadelphia Inquirer, Philadelphia, Pennsylvania, United States.

*Primary Examiner*—Ed Swinehart

*Attorney, Agent, or Firm*—Duane, Morris & Heckscher, LLP

[57] ABSTRACT

A flotation device carries two or more people down a waterslide on shaped flotation tubes, coupled by flexible straps into a train. The bows and the sterns of adjacent buoyant bodies are complementarily shaped, preferably the bow being circularly convex and the stern concave as viewed in plan. The straps hold the bow and stern together at a minimal gap, constraining relative rotation by the convex/concave engagement of the bow and stern. In addition, lateral shoulders on the bow abut against the ends of the concave stern to prevent rotation beyond a predetermined angle, for example wherein the bodies in the train are relatively rotated to a bend having about a ten foot radius. This structure provides sufficient flexibility to traverse relatively tight turns in the waterslide course while preventing buckling or accordion-fold collapse when the train of buoyant bodies encounter an obstruction such as a splash down pool.

16 Claims, 5 Drawing Sheets

TRAIN COUPLEABLE FLOTATION TUBE FOR WATERSLIDES

BACKGROUND OF THE INVENTION

1. Field of the Invention

The invention relates to the field of aquatic recreation apparatus and in particular concerns a flotation tube that is nestably coupleable to other similar tubes to form a semi-rigid elongated train. Laterally spaced flexible straps hold successive tubes together at complementary convex/concave abutting surfaces that allow the train to bend around a curve but the structure is such that the train cannot collapse or buckle, for example, when the front tube(s) encounter an obstruction such as a splash down pool.

2. Prior Art

A waterslide typically involves a path with an elongated trough or sluice in which water flows, in an amount at least sufficient to wet the surfaces and in many instances moving a substantial volume of water per unit time. The trough usually defines a continuously downward flow path and drains water that is pumped upwardly from a splash down pool at the end of the course to an entry point at the entrance.

There are various known configurations. A deep water ride may carry a flow on which riders float, or the riders may skim over a thin layer of water, or a gush of water may carry the riders along turbulently. A course may be relatively steep or have a mild gradient. In an uphill/downhill course the water may pool in the valleys and require draining or the course may have some places where the water is relatively deep and/or fast flowing and other places that are merely wetted, such as uphill runs. For excitement, the course often has banked turns.

The nature of the flow of water is determined by the contour of the sluice, including its width, curvature and vertical gradient, and by the amount of water flowing in the sluice at any particular point. Sluices or slides can lead to intermediate pools, and outlets or alternative outlets from intermediate pools can lead to further slides, etc.

The sluice can define a sinuous path, and the curves are correspondingly banked such that the flow of water due to inertia is not restricted to the lowest cross-sectional portion of the sluice, but rather rises along the sides of the sluice. Accordingly, in traversing turns the riders become canted to an angle defined by the surface of the water flowing around the turn.

Waterslide riders can traverse the slides with or without flotation devices or sliding mats, however such devices are preferred due to their ability to protect the rider from friction with the sluice. Flotation devices also support the riders in relatively deep water. Whether a particular waterslide sluice is apt for persons alone or for persons with flotation devices is a matter of the width of the sluice, the character of its surfaces, the rider's speed and the flow of water. The sluice width is such that the rider or the rider's flotation apparatus is confined between the sidewalls. The sluice may be correspondingly narrow to prevent the rider or flotation device from turning laterally to the flow and obstructing flow and traffic or subjecting the rider to friction along the sluice sidewalls.

Air mattresses have been used for flotation in waterslide parks, as have vehicle inner tubes. However, an air mattress or inner tube of the type often used for placid floating may not be suitable for riding a waterslide. Accordingly, reinforced and adapted versions of such flotation devices have been developed. For example, U.S. Pat. No. 5,020,465—

Langford discloses a variation on an inner tube, having a relatively sharper prow and blunt stern with complementary couplings permitting the attachment of several such devices in lines or arrays. U.S. Pat. Nos. 5,011,134 and 5,230,662 disclose sliding mat variations having toboggan-like fronts and handles. U.S. Pat. No. 5,453,054—Langford discloses a different tube variation with couplings that, like Langford '465 are pivotable on a vertical axis. The foregoing patents disclose various details of flotation devices as well as waterslides, and their disclosures are hereby incorporated.

Tubes are comfortable and convenient flotation devices because a person can sit comfortably upright in the central opening defined by the tube, with the user's legs hanging over the sides. Durable versions of the tubes having fabric surfaces resist damage from friction, for example the friction occurring between the tube and the sides of waterslide sluices. Such tubes are typically made of resin embedded in a fiber as the wear-resistant external skin of an inflatable tube. The tubes can have handles on the top surface, to steady a rider when sitting upright, and back rests, etc. Due to these beneficial attributes, tubes have become a preferred form of flotation device for waterslide parks wherein the riders traverse a sluice on an individual flotation device.

Single and multiple tubes and tube connections are possible. Riders of waterslides frequently attend in or form groups. Members of a group find it enjoyable to traverse the slide together. Although traversing the sluice one after another is in a sense traversing the sluice together, riders may join hands and traverse the slide single file. Of course, when joining hands makes it difficult to maintain a hold on any handles that may be provided on the rider's tube. To serve the users' desires, park operators may supply an integrally double tube or "double doughnut" wherein an inflatable body in a figure eight shape provides apertures for two riders to sit. Such a device is relatively rigid and is impractical in units of more than two rider positions. The long longitudinal axis causes wear on the tube when traversing curves or limits the minimum radius of curves, or cause wear at vertical diversions and changes in slope, or causes problems in wider areas such as pools.

US Pat. No. 5,507,674—Yeung discloses a plurality of tubes that are coupleable in a single file by pairs of mating connectors on opposite sides of the tubes. The connectors in the pairs are spaced on the tube and the round shape of the tube causes the tube to protrude between the connectors. Thus, connected tubes bear relatively tightly against one another between the connectors, providing a train of tubes that is substantially as rigid as a double doughnut type. The Yeung patent is also hereby incorporated.

The coupled single rider tubes of the Langford '465 and '054 patents, which pivot on a vertical coupling axis, ameliorate the difficulty with rigidity and permit a line of two or more connected tubes to bend to follow a curve. However, other problems are presented. The couplings permit a certain longitudinal play or slack in the train. The couplings also are quite free to pivot, both on a vertical axis and a horizontal axis. As a result, when a line of coupled tubes encounters an obstruction, the train of tubes can be longitudinally compressed and may tend to collapse into an accordion fold. This can occur at points such as a splash down pool when the leading tube(s) of a fast moving tube train encounter the obstruction of deep water, and is undesirable.

To deal with accordion fold collapse, a designer may choose to reduce the gradient of the course so that obstructions such as the splash down pool do not produce the sudden braking that causes such collapse. However, this reduces the speed and excitement of the ride. Alternatively the designer may choose an integral multi-rider tube or another rigid train arrangement. However, all the curves along the course then are required to have a minimum turning radius that will accommodate the longest rigid tube train, which also reduces the excitement of the ride. What is needed is a tube train structure that balances the need for flexibility, for negotiating turns and gradient changes, with the need for structural integrity and rigidity of the train of coupled tubes.

SUMMARY OF THE INVENTION

In its broadest aspects, the invention provides a flotation device comprising at least two buoyant bodies each having a bow and a stern, and preferably a central aperture for the rider, wherein the bows and the sterns are shaped to complement one another such that the bodies nest longitudinally. Means are provided for flexibly fastening together the buoyant bodies in their nested relationship, so as to constrain each bow and stern to a movement complementary to their abutting surfaces.

In one embodiment, one of the bow and the stern is convex in plan view and the other is concave. A pair of attachment structures are disposed adjacent to each of the bow and the stern of the buoyant bodies in arcuately spaced relation to their respective concave or convex outer surfaces. In this embodiment, the arcuate spacing between the pair of attachment structures on the convex side can be less than the spacing of the attachment structures on the concave side. Flexible straps, preferably having mating male and female fasteners at their free ends, are affixed to each attachment structure and join the stern of one of the buoyant bodies with the bow of the next following body. Preferably, the bows of the tubes are convex and the sterns are concave, causing the straps to flare laterally outwardly in the forward direction.

The invention is advantageously applied to a system of aquatic recreation comprising a waterslide amusement including down-hill and optionally up-hill runs, as well as a plurality of curved sections. The convex/concave nested tubes preferably are coupled sufficiently closely by the flexible straps that at least a portion of their facing surfaces come into contact when traversing curves. By providing a slight longitudinal clearance between tubes when the tubes are straight in line, for example about 0.75 inch, or by use of resiliently extensible material for the straps, the train of tubes can readily conform to a minimum radius of curvature, preferably about ten feet. However, the structure limits the extent to which successive tubes can pivot and thereby prevents an accordion collapse of the tube train when the leading tube(s) encounter an obstruction.

BRIEF DESCRIPTION OF THE DRAWINGS

Other features and advantages of the invention will be apparent from the following detailed description of preferred embodiments, which are to be considered together with the accompanying drawings, wherein like numbers refer to like parts, as well as the appended claims. In the drawings, FIG. I is a top view of a flotation train formed in accordance with the invention;

DETAILED DESCRIPTION OF THE PREFERRED EMBODIMENT

Figure 1:
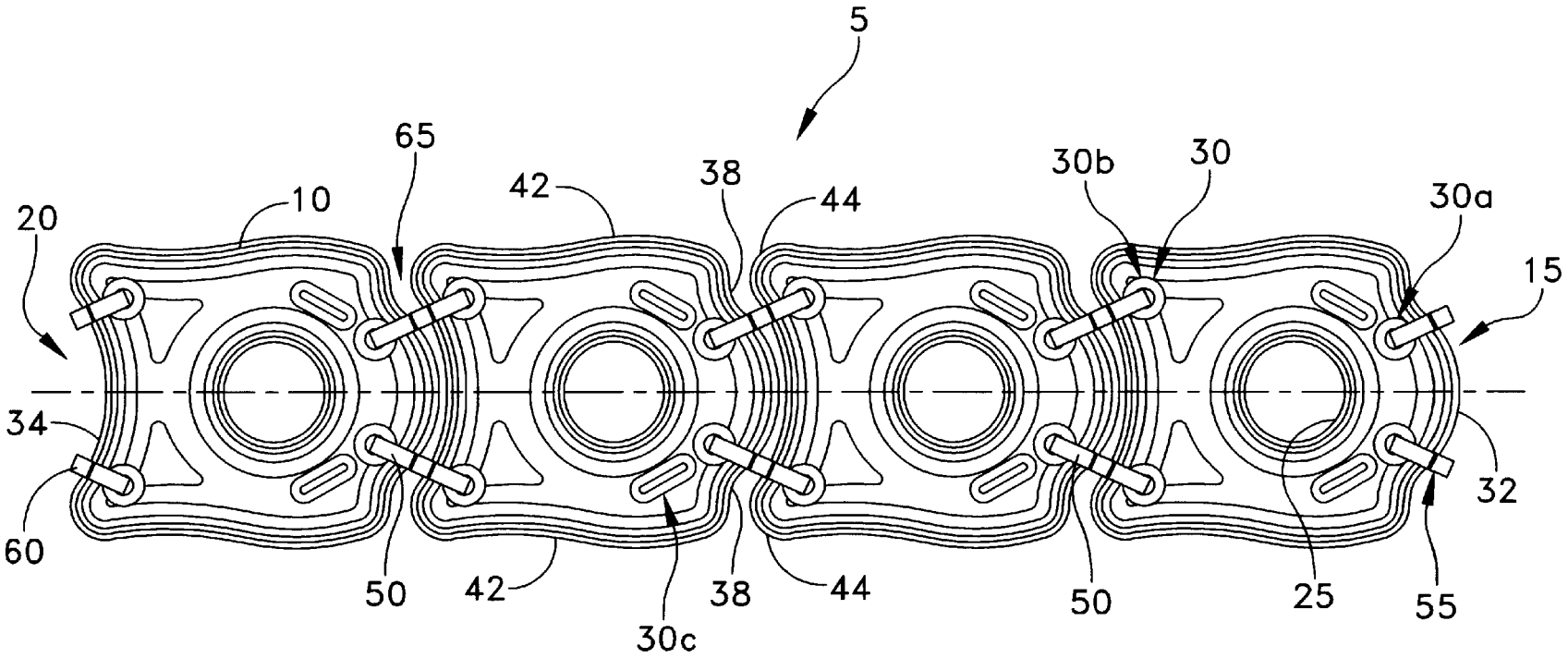

A flotation train 5 as shown in FIG. 1 is made up of two or more bodies 10, each preferably shaped generally as a tube, and each comprising a bow 15, a stern 20, a central rider's compartment 25, and a plurality of attachment structures 30. For convenience in describing the invention, the nautical terms "bow" and "stern" are used herein, and should be considered to have their usual meanings, i.e., the front and rear ends of a boat in the normal direction of travel. Bodies 10 are preferably buoyant, but the invention is also applicable to similarly shaped rider supporting structures that slide over wetted surfaces or the like as opposed to floating. Bodies 10 may comprise a flexible inflated envelope or may comprise solid or foamed buoyant material such as kapok, foamed polystyrene or the like, or they may be hollow. Preferably bodies 10 are hollow, flexible and inflated, having a structure comparable to that of a vehicle tire inner tube, with an external covering of resinous fiber or fabric to resist wear.

Bow 15 and stern 20 define opposite longitudinal ends, with central aperture 25 disposed between them and centered relative to a longitudinal axis through body 10. Central aperture 25 is typically circular and about a foot wide at its minimum inside diameter, widening upwardly due to the generally toroidal shape of body 10.

Bow 15 and stern 20 form complementary curved contours. In the embodiment shown, each bow 15 comprises a convexly curved portion 32 and each stern 20 comprises a concavely curved portion 34 (FIG. 2) as viewed in plan. Bow 15 and stern 20 can also be complementarily convex and concave as viewed in side elevation, but preferably both are convexly rounded as so viewed. The terms "complement," "complementary" and the like, as used herein to describe the contour of buoyant bodies 10, have the ordinary meaning to fill-in, complete or match. However the advantages of the invention can be obtained if the bow and stern are partly complementary as opposed to being precise mirror images in three dimensions, and in addition, the forward facing contour of the bows preferably have lateral shoulders extending laterally outwardly relative to the curved concavity of the stern as discussed below. Nevertheless, when two or more buoyant bodies 10 are placed in line bow to stern (FIGS. 1, 3 and 4), the convexly curved portions 32 of the rearward bodies 10 substantially fit the concavely curved portion 34 of stern 20 of the next adjacent buoyant body 10.

Convexly curved portion 32 can form a substantially circular section of arc extending, for example, over about 90 degrees as shown and having a radius from about one to 2.5 feet. Insofar as the bow is toroidal in shape, the torus has an outside diameter in plan of about five feet, forming a doughnut shaped tube having a section about one foot in diameter.

A pair of concave recesses 38 are formed between each side of convex portion 32 and the front corners 40 of bow 15, thus providing lateral shoulders on bow 15, against which the rear corners of the stern of the next body 10 abut at a predetermined pivot angle relative to the first body. Concave recesses 38 join concave portion 32 smoothly around the shoulders with the sides 42 of buoyant body 10. Comers 44 of stern 20 are rounded so as to complement the recesses 38 of an adjacent bow 15. Stern 20 can have a radius of curvature equal to that of bow 15, but preferably has a slightly larger radius of curvature. For example, stern 20 can have a radius one inch longer than the radius of bow 15 so that when the coupled bodies 10 are spaced by a one inch longitudinal gap, the convex and concave surfaces are evenly spaced all along the junction.

Each body 10 preferably comprises front and rear attachment structures for receiving flexible straps 50 that attach the successive bodies together. The attachment structures can comprise, for example, surface-attached receptacles having an annular bezel attached to the surface of body 10 with a bridge member extending across the central opening, around which a strap 50 can be passed. Alternatively, the attachment structures can comprise open-ended passageway members forming through holes that extend through the body in a vertical direction, the strap 50 extending therethrough. Other connections for straps 50 are also possible, the object being to form a flexible coupling between bodies 10 with sufficient clearance that bodies 10 can be relatively rotated until the stern comers 44 abut against the shoulders of bow 15 at recesses 38, thereby permitting free relative rotation but only over a limited angle.

Figure 2:
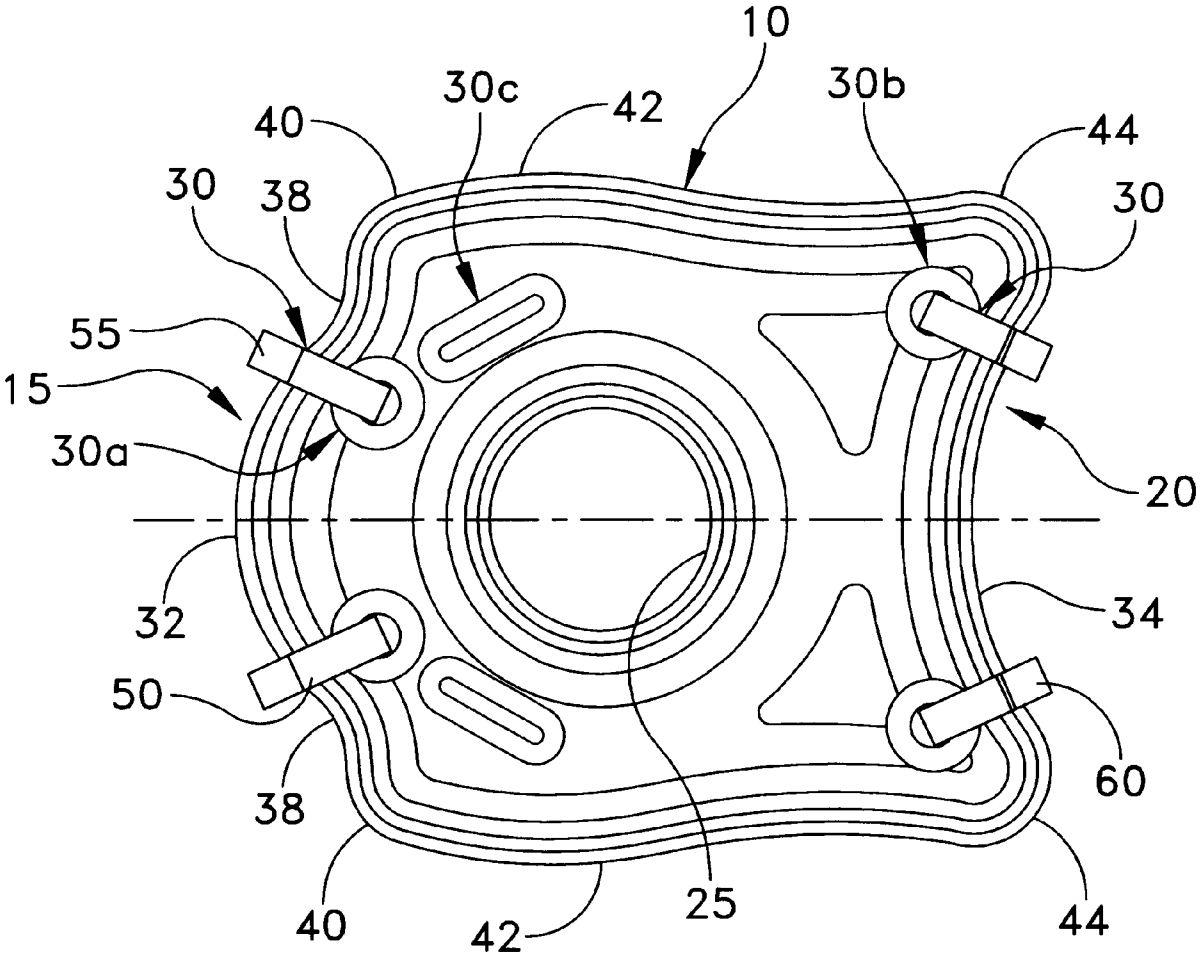
FIG. 2 is a top view of an individual flotation device from the flotation train shown in FIG. 1.

A first pair of attachment structures 30*a* are arcuately spaced from one another adjacent to bow 15. A second pair of attachment structures 30*b* are arcuately spaced from one another adjacent to stern 20. As best shown in FIGS. 1 and 2, the spacing between the first pair of attachment members 30*a* is less than the spacing between the second pair 30*b*. A third pair of members 30*c* are disposed on the upper surface of body 10 and form or receive handle grips for use by a rider to maintain a hold on an individual body 10.

First and second pairs of attachment members 30*a*, 30*b* are sized and shaped so that each may receive an end or an intermediate length of strap 50 for securing two adjacent buoyant bodies 10 together. Straps 50 include mating fasteners such as spring clip male and female fasteners 55, 60, that are disposed on the free ends of each strap. Separate short straps can be affixed at one end to a respective attachment member 30*a*, 30*b* with fasteners for attachment to a complementary fastener on its opposed strap. In the event the straps are continuous loops, the opposite ends of each strap have complementary fasteners and pass through the attachment members 30*a*, 30*b* to affix the bodies together via a closed circle of strap. Straps 50 have a length sufficient to affix bodies 10 together at a slight clearance or gap 65, for example from 0.75 to 1.5 inches and preferably about 1.0 inch measured longitudinally, when bodies 10 are in line.

Figure 4:
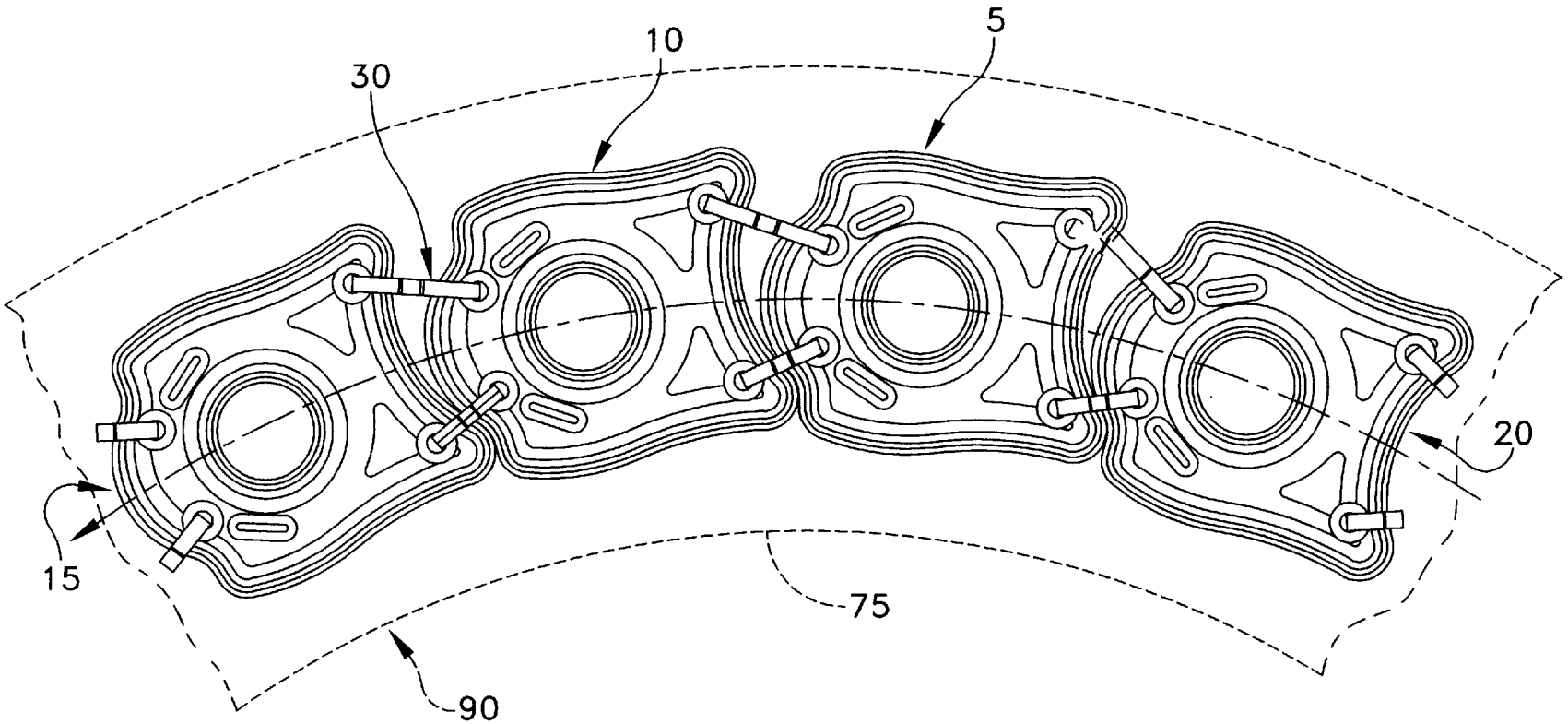
FIG. 4 is a top view of the invention, similar to that shown in FIG. 1, but showing the relative orientation of the individual floatation devices of a train when subjected to a curved section of a typical waterslide amusement.

As illustrated in FIGS. 1 and 4, once assembled to adjacent buoyant bodies 10, straps 50 are aligned radially to central aperture 25 and subtend an angle between them of about 60 degrees. This angle can be somewhat higher or lower, for example between 45 and 90 degrees. However, the straps diverge outwardly, away from the bow due to the difference in spacing of attachment structures 30*a* and 30*b*. This angular arrangement of straps 50 provides for freedom of complementary movement between adjacent buoyant bodies 10.

Figure 3:
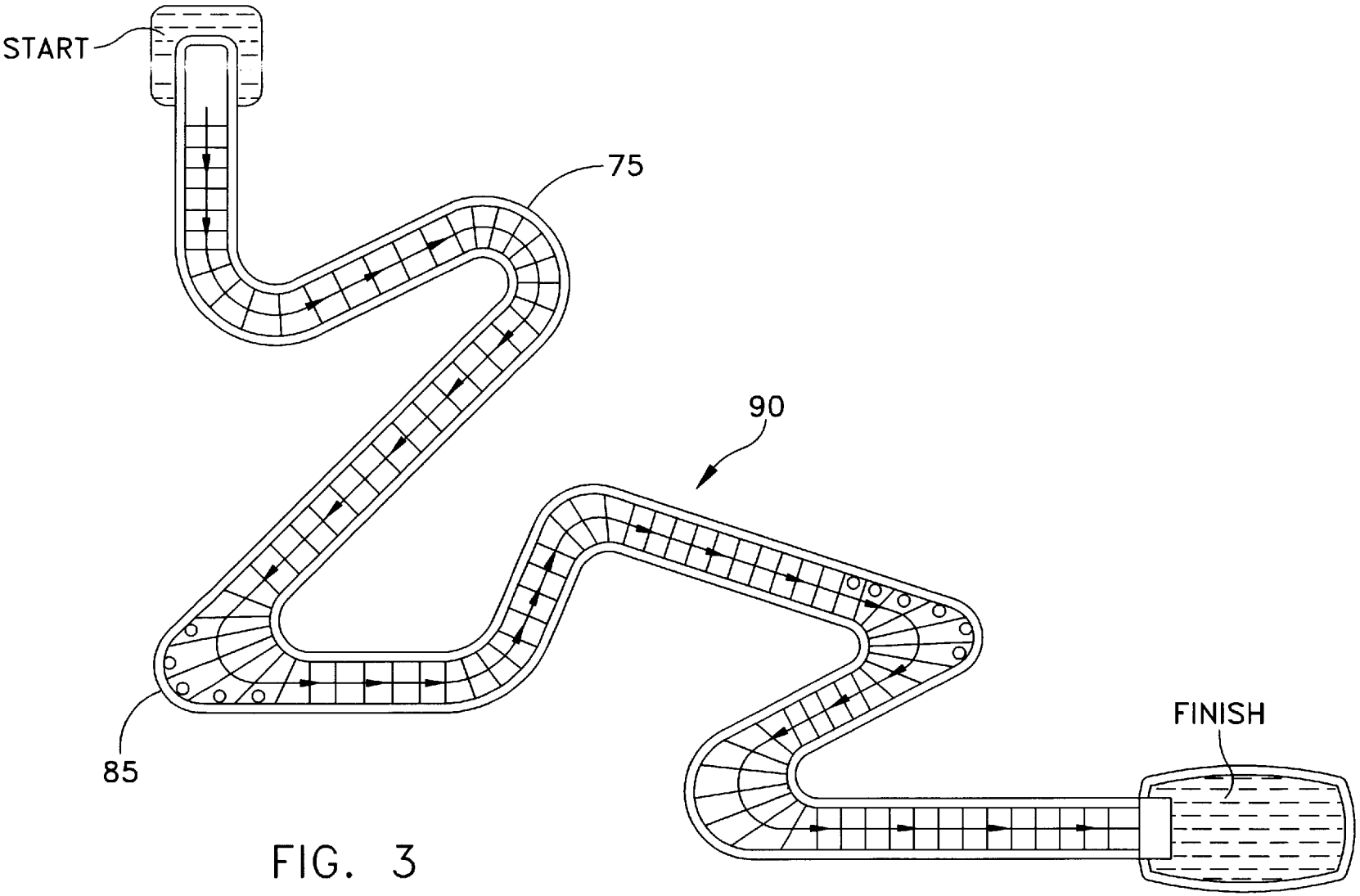
FIG. 3 is a top view of a typical waterslide amusement of the type for which the invention is contemplated for use.

More particularly, each bow 15 is capable of sliding along the surface of the abutting stern 20, thereby relatively rotating the adjacent bodies 10. Such rotation preferably is about the center axis of central aperture 25 and perpendicular to the longitudinal axis of the buoyant bodies, allowing flotation train 5 to bend laterally when traversing curved sections of a typical waterslide amusement (FIGS. 3 and 4). However, due to the angular arrangement of straps 50 and the eventual abutment of comers 44 and the shoulders at recesses 38, excessive bending or buckling of the flotation train 5 is prevented. This feature of the present invention is unlike prior art structures in which substantial stress is placed on the straps (when bending stresses are present) that would fold the train accordianwise. The present invention's convex/concave shape provides mechanical engagement, as discussed hereinabove, which substantially reduces the propensity of the train to fold accordianwise. If, in addition to the use of the aforementioned mechanically engaging structures, the specific structures are inflatables, the resistance to accordianwise folding is further enhanced. Thus, with inflatable bodies 10, the resilient compression of each body 10 bears the stresses rather than using straps as the primary means to bear the stress. With this construction, the shoulders of the following bow 15 bearing against the stern receptacles of the stern of the leading tube are particularly effective to resiliently bear stress in a manner that is more durable than would be possible if relying on straps.

Bodies 10 are symmetric about the longitudinal axis. Thus the limit on relative rotation and the ability to traverse a turn or bend is equal whether the flotation train 5 is traversing a "right-handed" curve 75 or "left-handed" curve 85 on a waterslide 90 (FIGS. 3 and 4). The extent of permitted bending is variable by suitable adjustment of the relative dimensions of the bow, stern, straps, etc. In the embodiment shown and using the dimensions discussed above, a four-tube train can readily traverse a waterslide curve having a radius as little as ten feet.

Figure 5:
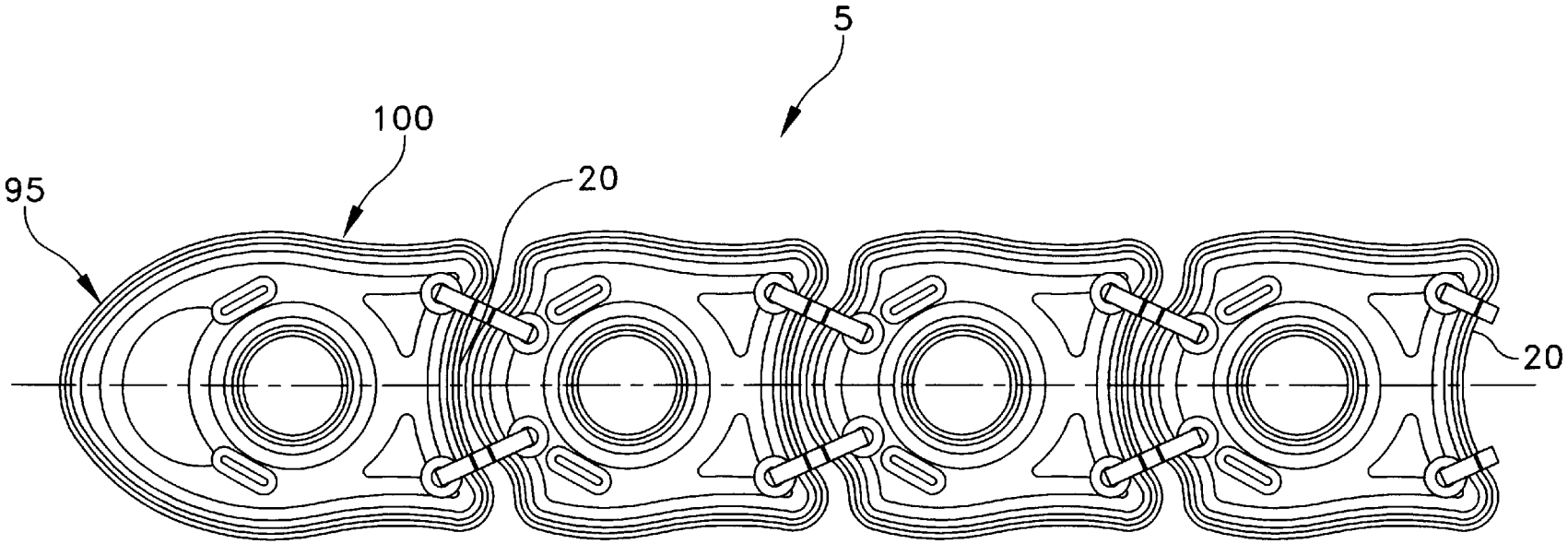
FIG. 5 is a top view of a flotation train formed in accordance with an alternative embodiment of the invention

Various changes and modifications may be made to the foregoing preferred embodiments without departing from the scope of the invention. For example, as shown in FIG. 5, bow 95 of a leading body 100 may have an entirely convex shape. Stem 20 of body 100 has a concave shape identical to that disclosed in connection with body 10. The convex shape of bow 95 helps flotation train 5 cut through the water of waterslide 90 by decreasing the amount of drag experienced on body 100. A convex bow also contains substantially more air than a toroidal shape, which improves flotation at the front and minimizes the extent to which the bow can submerge and cause deceleration. Instead, the device is more prone to skimming and less prone to hydraulic drag.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. A flotation device comprising:

at least two bodies, each having a bow and a stern, wherein one of said bow and said stern is substantially convex and the other of said bow and stern is substantially concave, the bows and the sterns of the at least two bodies being complementary and defining a limited angle of relative rotational freedom between the bodies; and, movable means for fastening together said bodies bow to stern so that each bow is constrained to complementary movement relative to each stern, wherein said means for fastening comprises a first pair of attachment structures arcuately spaced from one another adjacent to said bow and a second pair of attachment structures arcuately spaced from one another adjacent to said stern, wherein said first pair of attachment structures is spaced more closely than said second pair of attachment structures; and, the movable means for fastening comprises at least two flexible straps affixing together the attachment structures between said bow and said stern.

2. A flotation device according to claim 1 wherein said straps are positioned relative to one another within said passageways and between said bodies so as to subtend an angle between them in the range from about 45 to about 90 degrees.

3. A flotation device according to claim 2 wherein said adjacent bodies as affixed define a gap between them of less than about 0.75 to 1.5 inches.

4. A flotation device according to claim 1 wherein said bodies comprise protrusions at end portions of said stern and complementary recesses at lateral sides of the bow, relative rotation of the bodies being constrained by abutment of the protrusions and the complementary recesses.

5. A flotation device comprising:

at least two buoyant bodies, each having a convexly curved bow surface and a concavely curved stern surface, said at least two bodies having bows and sterns that are substantially complementary;

a first pair of attachment structures spaced laterally adjacent to the bow and a second pair of attachment structures spaced laterally adjacent to the stern, the first pair of attachment structures being more closely spaced than the second pair, the attachment structures being affixed to the bodies and being structured to receive straps; and, at least two of said straps, each having at least one fastener, the straps being flexible and attachable between the attachment structures to flexibly fasten together said buoyant bodies in a nested relationship, so as to constrain the relative rotation of each bow and each stern to a movement complementary to the abutting bow and stern surfaces.

6. A flotation device according to claim 5 wherein the attachment structures are spaced such that said straps subtend an angle of about 60 degrees.

7. A flotation device according to claim 6 wherein said adjacent buoyant bodies as attached by the straps define a gap between them of less than about 0.75 to 1.5 inches.

8. A flotation device according to claim 5 wherein said bodies have a central aperture for receiving a rider, the convexly curved bow forming a circular arc substantially concentric with the central aperture, whereby the bodies are constrained to relative rotational movement about an axis of the central aperture.

9. A flotation device according to claim 8 wherein said buoyant bodies are relatively rotatable to a bend radius of about ten feet.

10. A flotation device according to claim 8 wherein said buoyant bodies comprise protrusions at end portions of said stern and complementary recesses at lateral sides of the bow, relative rotation of the bodies being constrained by abutment of the protrusions and the complementary recesses.

11. A flotation device comprising:

at least two buoyant bodies each having a central aperture, a convexly curved bow and a concavely curved stern, wherein said bows and said sterns are complementary; and flexible means for fastening together said buoyant bodies bow to stern and means for constraining the relative movement of said bows to said sterns so that each bow is constrained to complementary rotational movement relative to each stern wherein said central aperture of each of said buoyant bodies defines the axis of said constrained rotation of each of said bows and said means for constraining said relative rotation include protrusions formed by end portions of said stern and complementary recesses formed by end portions of said bow.

12. A flotation device according to claim 11 wherein said fastening means include a first pair of attachment structures spaced from one another and adjacent to said bow and a second pair of attachment structures spaced from one another and adjacent to said stern, the first pair being more closely spaced than the second pair;

at least two straps, each being affixable to the attachment structures and having at least one fastener, said straps being extending between the attachment structures for affixing the bow of a rearward one of the bodies to a stern of a forward one of the bodies.

13. A flotation device according to claim 12 wherein said straps diverge laterally from the bow of the rearward body to the stern of the forward body.

14. A system for providing aquatic recreation comprising:

a waterslide amusement comprising a down-hill run and at least one curved section having a radius of curvature of about ten feet;

a flotation device comprising at least two buoyant bodies each having a convexly curved bow and a concavely curved stern, wherein said bows and said sterns are complementary and include protrusions formed by end portions of each of said sterns and complementary recesses formed by end portions of each of said bows; and, flexible means for fastening together said buoyant bodies bow to stern so that relative rotation of the bodies is constrained by abutment of the recesses formed by said end portions of each of said bows of a rearward one of the flotation devices and the protrusions formed by said end portions of each of said sterns of a forward one of the flotation devices.

15. A flotation device comprising:

at least two resilient bodies, each having a bow and a stern, wherein said bow comprises a convexly shaped portion and said stern comprises a concavely shaped portion, the bows and the sterns of the at least two resilient bodies being complementary and defining a limited angle of relative rotational freedom between the bodies;

a first pair of attachment structures spaced from one another adjacent to said bow and a second pair of attachment structures spaced from one another adjacent to said stern; and at least two flexible and resilient straps affixing together the attachment structures between said bow and said stern so as to fasten said resilient bodies bow to stern such that each bow is constrained to complementary movement relative to each stern.

16. A flotation device according to claim 15 wherein said first pair of attachment structures is spaced more closely than said second pair of attachment structures.

* * * * *